US012440880B2

(12) United States Patent
Suehiro et al.

(10) Patent No.: US 12,440,880 B2
(45) Date of Patent: Oct. 14, 2025

(54) METHOD OF DETERMINING TENSION PATTERN AND METHOD OF COILING STEEL SHEET

(71) Applicant: JFE STEEL CORPORATION, Tokyo (JP)

(72) Inventors: Ryuichi Suehiro, Tokyo (JP); Naoki Watanabe, Tokyo (JP); Ryosuke Watanabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 422 days.

(21) Appl. No.: 17/998,807

(22) PCT Filed: May 19, 2021

(86) PCT No.: PCT/JP2021/019066

§ 371 (c)(1),
(2) Date: Nov. 15, 2022

(87) PCT Pub. No.: WO2021/235498

PCT Pub. Date: Nov. 25, 2021

(65) Prior Publication Data

US 2023/0234116 A1 Jul. 27, 2023

(30) Foreign Application Priority Data

May 19, 2020 (JP) ..... 2020-087707

(51) Int. Cl.

| | |
|---|---|
| ***B21C 47/14*** | (2006.01) |
| ***B21C 47/04*** | (2006.01) |
| ***B65H 23/195*** | (2006.01) |
| ***C21D 8/02*** | (2006.01) |
| ***C21D 9/46*** | (2006.01) |

(52) U.S. Cl.

CPC ..... *B21C 47/146* (2013.01); *B21C 47/045* (2013.01); *B65H 23/195* (2013.01); *C21D 8/0242* (2013.01); *C21D 9/46* (2013.01)

(58) Field of Classification Search

CPC ... B21C 47/146; B21C 47/045; B21C 47/003; B21C 47/04; B21C 47/345; B21C 51/00;

(Continued)

(56) References Cited

U.S. PATENT DOCUMENTS 9,514,868 B2 * 12/2016 Omura ..... C21D 8/1288
2005/0016241 A1 * 1/2005 Noe ..... B21D 1/05 72/183

(Continued)

FOREIGN PATENT DOCUMENTS

JP S4642692 B1 12/1971
JP S6270523 A 4/1987

(Continued)

OTHER PUBLICATIONS

Apr. 12, 2022, Notification of Reasons for Refusal issued by the Japan Patent Office in the corresponding Japanese Patent Application No. 2021-542211 with English language Concise Statement of Relevance.

(Continued)

*Primary Examiner* — Charles R Kasenge
(74) *Attorney, Agent, or Firm* — KENJA IP LAW PC

(57) ABSTRACT

Provided are methods that can prevent either or both of kinking and collapsing of a steel sheet coiled in coil form regardless of the characteristics of the steel sheet. A method of determining a tension pattern of tension applied to a steel sheet to coil the steel sheet in coil form comprises calculating the tension pattern using an apparent elastic modulus in a radial direction of a coil.

11 Claims, 5 Drawing Sheets

(58) Field of Classification Search
CPC ..... B65H 23/195; B65H 2515/314; B65H 2701/173; B65H 18/28; C21D 8/0242; C21D 9/46
See application file for complete search history.

(56) References Cited

U.S. PATENT DOCUMENTS

| | | | | |
|---|---|---|---|---|
| 2017/0271640 | A1* | 9/2017 | Sakamoto | H01M 50/494 |
| 2019/0312249 | A1 | 10/2019 | Sakamoto | |

FOREIGN PATENT DOCUMENTS

| | | | |
|---|---|---|---|
| JP | S63140035 | A | 6/1988 |
| JP | S63288856 | A | 11/1988 |
| JP | H0671337 | A | 3/1994 |
| JP | 2717022 | B2 | 2/1998 |
| JP | 2012017159 | A | 1/2012 |
| JP | 2012188221 | A | 10/2012 |
| JP | 2013180879 | A | 9/2013 |
| JP | 2017168327 | A | 9/2017 |

OTHER PUBLICATIONS

Jun. 29, 2021, International Search Report issued in the International Patent Application No. PCT/JP2021/019066.
Oct. 13, 2023, the Extended European Search Report issued by the European Patent Office in the corresponding European Patent Application No. 21808193.3.

* cited by examiner

METHOD OF DETERMINING TENSION PATTERN AND METHOD OF COILING STEEL SHEET

TECHNICAL FIELD

The present disclosure relates to a method of determining a tension pattern and a method of coiling a steel sheet.

BACKGROUND

When shipping a steel sheet such as a cold-rolled steel sheet as a product or conveying the steel sheet to the next process, the steel sheet is usually conveyed in coil form. The steel sheet is coiled while applying appropriate tension to the steel sheet on a mandrel of a tension reel in a production line. The coiled steel sheet is removed from the mandrel and conveyed.

Troubles that can occur in the steel sheet coiled in coil form include kinking in which the innermost winding portion (innermost diameter portion) of the coil buckles and protrudes inward in the radial direction, and collapsing in which, in the case where the coil is in a down end state in which its cylindrical surface as the side surface stands vertically with respect to the ground, the coil deforms by gravity. If such kinking or collapsing occurs, in the case where the steel sheet is a product, the product value is lost and the yield rate decreases. In the case where the steel sheet is an intermediate material, the steel sheet cannot be inserted in a pay-off reel for delivering the coil in the next process, and the yield rate decreases.

Kinking is considered to occur because the circumferential stress of the coil inner winding portion is excessively compressive to cause buckling. Collapsing is considered to occur because the radial stress between the layers of the coil (i.e. between the steel sheets forming the coil) is insufficient and consequently slippage occurs between the layers without friction. In view of this, techniques of changing tension when coiling a steel sheet are conventionally proposed in order to prevent kinking and collapsing of a coil.

For example, JP S62-70523 A (PTL 1) proposes a method of preventing collapsing of a coil by increasing the coiling tension on a coil inner winding portion and decreasing the coiling tension on a coil outer winding portion. JP S63-140035 A (PTL 2) and the specification of JP 2717022 B2 (PTL 3) each propose a method of preventing collapsing and kinking by making the tension on a coil inner winding portion and a coil outer winding portion lower than that on a coil middle winding portion when coiling a steel sheet to which an annealing separator is applied. JP H6-71337 A (PTL 4) proposes a method of preventing kinking by making the tension on a coil innermost winding portion lower than that on a coil outer winding portion and determining the tension on the coil innermost winding portion from the sheet thickness, deformation resistance, surface roughness, and oil application amount of the steel sheet.

CITATION LIST

Patent Literature

PTL 1: JP S62-70523 A
PTL 2: JP S63-140035 A
PTL 3:the specification of JP 2717022 B2
PTL 4:JP H6-71337 A

SUMMARY

Technical Problem

However, as can be understood from the fact that there are multiple coiling tension patterns considered as appropriate in PTL 1 to PTL 4, each individual technique can only be used under specific condition. In detail, if there is a change in the composition or sheet thickness of a steel sheet to be coiled or a change in whether the steel sheet surface is coated or the characteristics of the coating, even under the same coiling conditions, kinking or collapsing occurs in some cases and does not occur in other cases.

It could therefore be helpful to provide methods that can prevent either or both of kinking and collapsing of a steel sheet coiled in coil form regardless of the characteristics of the steel sheet.

Solution to Problem

We thus provide:

[1] A method of determining a tension pattern of tension applied to a steel sheet to coil the steel sheet in coil form, the method comprising calculating the tension pattern using an apparent elastic modulus in a radial direction of a coil.

[2] The method of determining a tension pattern according to [1], wherein when calculating the tension pattern, circumferential stress in the coil is used as an objective variable or a constraint condition.

[3] The method of determining a tension pattern according to [1] or [2], wherein when calculating the tension pattern, radial stress in the coil is used as an objective variable or a constraint condition.

[4] The method of determining a tension pattern according to any one of [1] to [3], wherein a sheet thickness of the steel sheet is 0.5 mm or less.

[5] The method of determining a tension pattern according to any one of [1] to [4], wherein the steel sheet has a coating layer on at least one surface thereof.

[6] A method of coiling a steel sheet, the method comprising: determining a tension pattern of tension applied to the steel sheet when coiling the steel sheet in coil form, by the method of determining a tension pattern according to any one of [1] to [5]; and coiling the steel sheet in coil form according to the determined tension pattern.

Advantageous Effect

It is thus possible to prevent either or both of kinking and collapsing of a steel sheet coiled in coil form regardless of the characteristics of the steel sheet.

Figure 1:
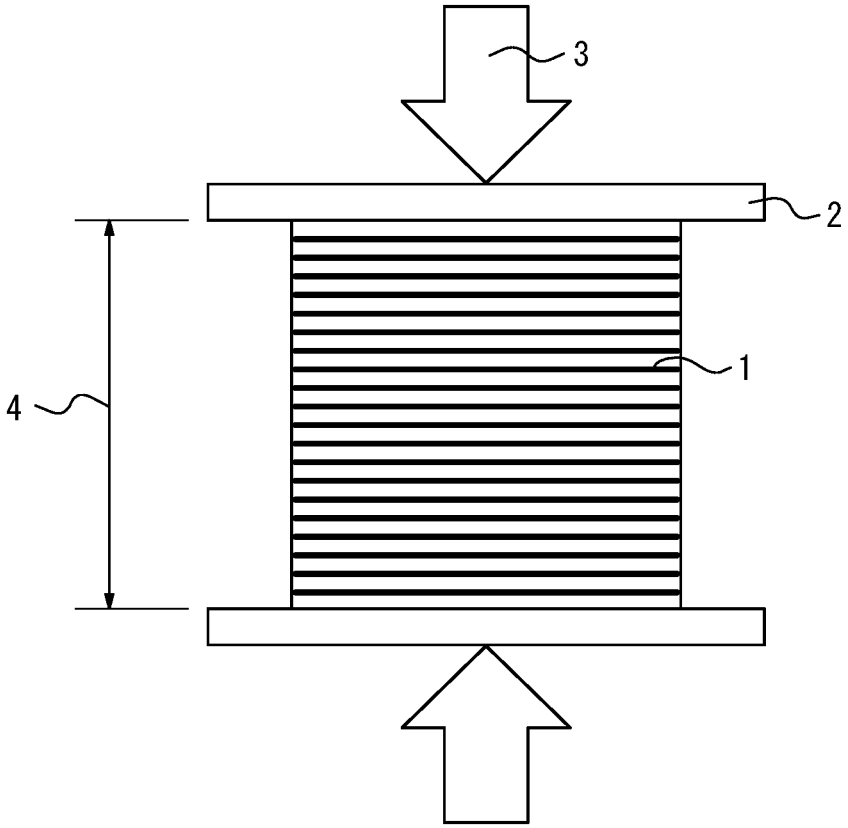
FIG. 1 is a diagram explaining a method of measuring the elastic modulus in the radial direction of a coil by stacking a plurality of steel sheets.

DETAILED DESCRIPTION (Method of Determining Tension Pattern)

One of the disclosed embodiments will be described below, with reference to the drawings. A method of determining a tension pattern according to the present disclosure is a method of determining a tension pattern of tension applied to a steel sheet to coil the steel sheet in coil form, comprising calculating the tension pattern using an apparent elastic modulus in a radial direction of a coil.

First, the reason why the apparent elastic modulus in the radial direction of the coil is used to determine the tension pattern applied to the steel sheet when coiling the steel sheet will be described below. Typically, when a steel sheet is coiled in coil form, even if there is no coating on the steel sheet surface, an air layer is present between the layers of the coil due to air entrainment or unevenness of the steel sheet surface. The presence of such an air layer causes the actual (apparent) elastic modulus in the radial direction of the coil to be lower than the elastic modulus of the bulk steel sheet.

Here, consider the case of further winding, on an outermost winding portion of a coil obtained by coiling a steel sheet, one layer of the steel sheet. Due to the tension applied to the steel sheet additionally coiled, the outermost winding portion of the coil already formed by coiling the steel sheet is subjected to pressure in the radial direction of the coil. This pressure in the radial direction changes the stress state in the coil already formed by coiling the steel sheet. The amount of the change varies depending on the apparent elastic modulus in the radial direction. Hence, if the apparent elastic modulus in the coil radial direction is different, even when the steel sheet is coiled under the same conditions, the stress state in the coil after the coiling is different.

Since collapsing and kinking of a coil each occur depending on the stress state in the coil, the difference in the apparent elastic modulus in the coil radial direction influences the occurrence of collapsing and kinking of the coil. Accordingly, by appropriately controlling the stress state in the coil after the coiling based on the apparent elastic modulus in the coil radial direction, the coil can be prevented from collapsing and kinking.

<Measurement of Apparent Elastic Modulus in Coil Radial Direction>

As the apparent elastic modulus in the coil radial direction used in the determination of the coiling tension pattern of the steel sheet, a value obtained through actual measurement is preferably used, but it is also possible to use a value assumed to approximate the apparent elastic modulus in the coil radial direction from experience and the like. The apparent elastic modulus in the coil radial direction is preferably measured in a state in which the steel sheet is coiled in coil form. Alternatively, the apparent elastic modulus in the coil radial direction may be measured using a laminate obtained by stacking steel sheets in the sheet thickness direction, to simplify measurement.

As an example, a method of measuring the apparent elastic modulus in the coil radial direction by stacking a plurality of steel sheets in the sheet thickness direction will be described below. FIG. 1 is a schematic diagram explaining a method of measuring the apparent elastic modulus in the coil radial direction. Specifically, first, a block 1 obtained by stacking a plurality of steel sheets in the sheet thickness direction is sandwiched between pads 2. Pressure 3 is then applied in the sheet thickness direction, and strain 4 in the sheet thickness direction of the block 1 is measured. Based on the measured strain 4, the elastic modulus in the sheet thickness direction of the block 1 is calculated. Thus, the apparent elastic modulus in the coil radial direction can be approximately calculated.

In the case where the number of steel sheets stacked in the block 1 is excessively small relative to the winding number (i.e. the number of turns) of the actual coil, the calculated elastic modulus in the coil radial direction deviates from the actual elastic modulus. The number of steel sheets stacked is therefore preferably not less than 20% of the winding number of the coil.

The method of measuring the strain 4 in the sheet thickness direction is not limited. Examples of the method include sandwiching a clip gauge between the pads 2 to measure the strain, and attaching a strain gauge to a side surface of the block 1 to measure the strain.

Regarding the pressure 3 applied to the block 1, in the case where the air layer or coating between the layers of the coil is very thin or Young's modulus of the coil is close to the Young's modulus of iron and the apparent elastic modulus is not pressure-dependent, the elastic modulus measured with pressure at one appropriate point may be used as a representative value (elastic modulus) of the coil. In the case where a coating layer sufficiently softer than iron, such as a coating or slurry, is present on the steel sheet surface, however, the elastic modulus may vary significantly depending on the pressure. In such a case, it is preferable to measure the elastic modulus as a function with respect to the pressure 3. In the case where the elastic modulus is measured as a function with respect to the pressure 3, the measured elastic modulus itself or an approximate value obtained by fitting the measured elastic modulus to an appropriate function may be used when calculating coiling tension.

<Calculation of Coiling Tension Pattern>

A method of calculating a coiling tension pattern of a steel sheet when coiling the steel sheet into a coil will be described below. As mentioned above, kinking and collapsing of a coil occur depending on the stress state in the coil after the steel sheet is coiled in coil form and the coil is removed from the mandrel. Hence, in the present disclosure, a model for predicting an in-coil stress distribution after coiling from a coiling tension pattern of a steel sheet is built, and a coiling tension pattern is determined using the model so as to achieve a desired in-coil stress distribution. Since the in-coil stress distribution depends on the apparent elastic modulus in the coil radial direction, the prediction model needs to be built using the apparent elastic modulus in the coil radial direction.

An example of the in-coil stress distribution prediction model will be described below. In this prediction model, coiling a steel sheet is regarded as stacking thin-walled cylinders as illustrated in FIG. 2, and, each time the steel sheet is coiled (wound) for one layer, the stress in the coil that has already been formed is updated to obtain the stress state after the coiling.

Figure 2:
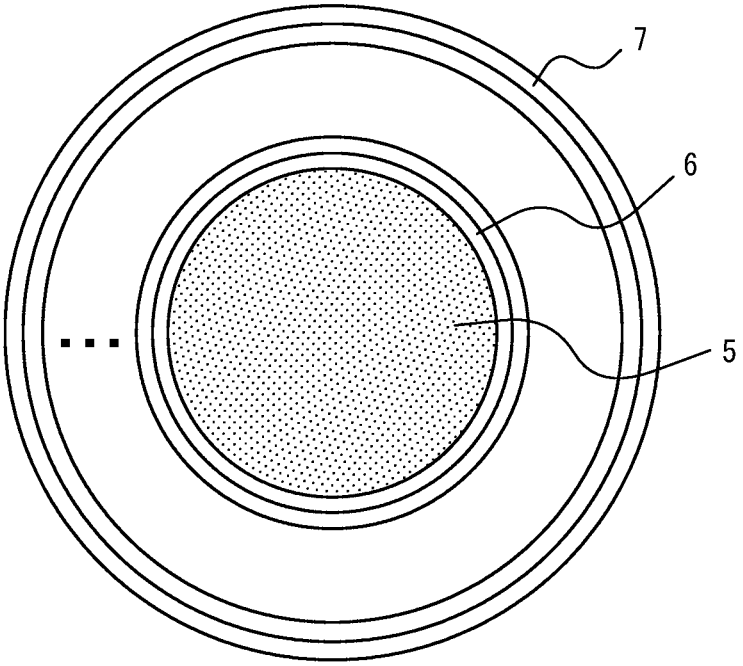
FIG. 2 is a diagram illustrating a state in which a coil is formed on a mandrel.

When the radial stress in a state in which the steel sheet is coiled from the cylinder of the innermost layer 6 of the coil as the first layer to the cylinder of the outermost layer 7 of the coil as the nth layer on a mandrel 5 in FIG. 2 is $\sigma_r$, the formula of equilibrium in the coil satisfies the following Formula (1):

$$r^2\frac{d^2\sigma_r}{dr^2}+3r\frac{d\sigma_r}{dr}+\left(1-g(\sigma_r)^2\right)\sigma_r=0. \tag{1}$$

Here, r is the radial position in the coil. Moreover, $g(\sigma_r)^2=E\theta/E_r(\sigma_r)$, where $E\theta$ is the elastic modulus in the circumferential direction of the coil, and $E_r(\sigma_r)$ is the apparent elastic modulus in the radial direction of the coil. As the value of $E_r(\sigma_r)$, a value actually measured by any of the foregoing methods is preferably used.

Suppose, when the steel sheet of the (n+1)th layer is wound around the outermost winding portion of the coil in an equilibrium state with tension T, the radial stress of the coil portion from the first layer to the nth layer changes to $\sigma_r$, $+\delta\sigma_r$. Stress increment $\delta\sigma_r$ follows the following Formula (2):

$$r^2\frac{d^2\sigma_r}{dr^2}+3r\frac{d\delta\sigma_r}{dr}+\left(1-g(\sigma_r+\delta\sigma_r)^2\right)\delta\sigma_r=\left\{g(\sigma_r+\delta\sigma_r)^2-g(\sigma_r)^2\right\}\sigma_r. \tag{2}$$

Here, in the outermost winding portion $r=r_s$ and the innermost winding portion $r=r_c$ of the coil, the following Formulas (3) and (4) representing boundary conditions are satisfied:

$$\delta\sigma_r(r_s)=-T\frac{\Delta r}{r_s} \tag{3}$$

$$\left.\frac{d\delta\sigma_r(r)}{dr}\right|_{r=r_c}=r\left(\frac{E_\theta}{E_c}-1\right)\frac{\delta\sigma_r(r_c)}{r}. \tag{4}$$

$\Delta r$ is the sheet thickness of the steel sheet. By repeatedly performing, each time the steel sheet is coiled for one layer, an operation of adding stress increment $\delta\sigma_r$ in the coil based on the foregoing formulas until a predetermined winding number is reached, stress distribution $\sigma_r^{on}$ in the coil after the coiling of the steel sheet is completed is obtained. Assuming that the stress distribution in the coil after the removal from the mandrel is $\sigma_r^{off}=\sigma_r^{on}+\delta\sigma_r$, stress increment $\delta\sigma_r$ from $\sigma_r^{on}$ n is obtained by calculating Formula (2) under the following Formulas (5) and (6) representing boundary conditions:

$$\sigma_r^{off}(r_c)=0 \tag{5}$$

$$\sigma_r^{off}(r_s)=0 \tag{6}$$

Stress distribution $\sigma\theta$ in the coil circumferential direction can be calculated using the following Formula (7):

$$\sigma_\theta=\sigma_r+r\frac{d\sigma_r}{dr}. \tag{7}$$

With the foregoing method, the stress distribution in the coil after the removal from the mandrel is obtained. Hence, the coiling tension pattern of the steel sheet can be changed so that the stress state in the coil will have such a distribution that is suitable for preventing kinking and collapsing. The model for predicting the stress distribution in the coil is not limited to the above-described model as long as it is a model based on the elastic modulus in the coil radial direction, and may be, for example, a method using finite element method (FEM) analysis or the like.

Figure 3:
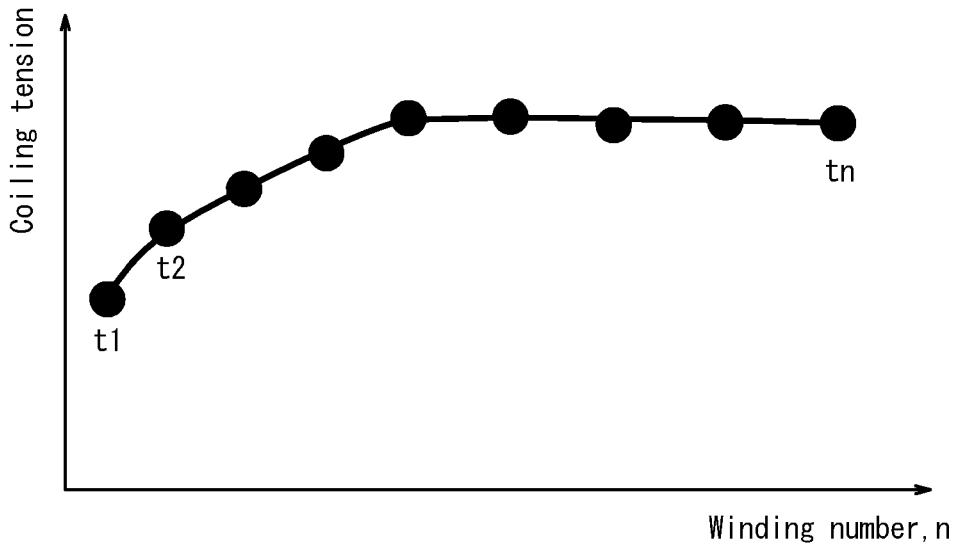
FIG. 3 is a diagram explaining a case of setting coiling tension for each winding number of a coil, when calculating a coiling tension pattern.
Figure 4:
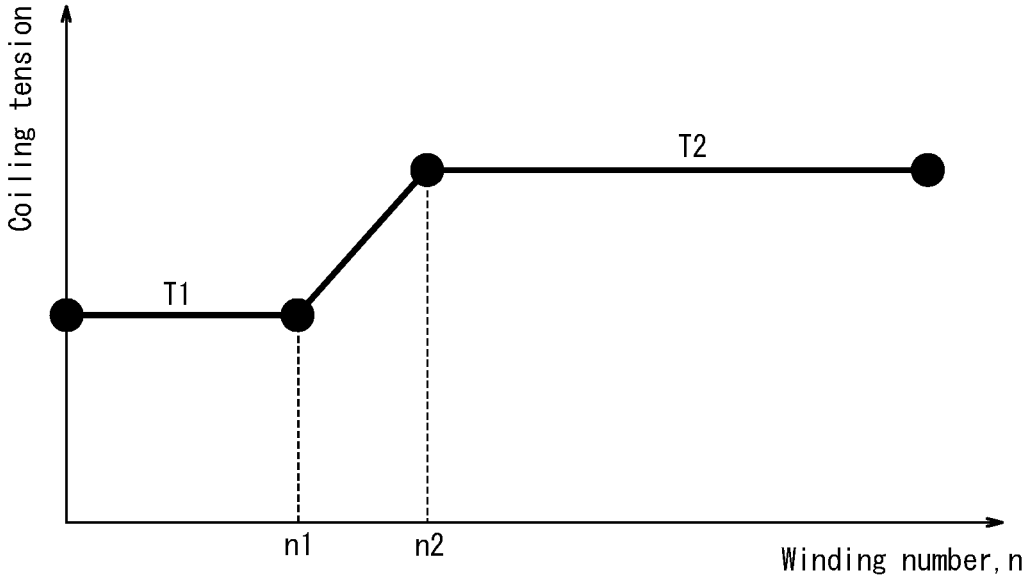
FIG. 4 is a diagram explaining a case of setting coiling tension using parameters, when calculating a coiling tension pattern.

The method of determining an appropriate coiling tension pattern is not limited as long as a desired stress state is achieved. An example is a method of performing optimization calculation using a coiling tension pattern as an input variable and a parameter relating to kinking and collapsing and an operation condition in an actual line as an objective variable or a constraint condition. For the coiling tension pattern as the input variable, a sequence of discrete coiling tension values for the respective winding numbers n may be given, as illustrated in FIG. 3. Alternatively, a simpler method of giving, as parameters, coiling tension values and each winding number n at which tension is changed may be used, as illustrated in FIG. 4.

The objective variable in the optimization calculation of the coiling tension pattern of the steel sheet is selected so as to be a condition with which either or both of kinking and collapsing can be prevented. As the constraint condition, a condition with which kinking or collapsing can be prevented and that is not given as the objective variable and a range of operation condition possible in a production line are given according to need. The constraint condition as the operation condition may be a condition appropriate for the corresponding production line. Examples include the upper limit and lower limit of the coiling tension, and the upper limit and lower limit of the change rate of the coiling tension.

A method of determining an item as the objective variable or the constraint condition when determining the stress distribution in the coil will be described below. Kinking is a defect in which the steel sheet buckles and protrudes inward in the radial direction in the case where the circumferential stress of the coil inner winding portion is strong compressive stress. From the viewpoint of preventing kinking, it is effective to give the circumferential stress in the coil as the objective variable or the constraint condition. Specifically, in the case where compressive stress is expressed as negative value, a condition that the circumferential stress of the coil innermost winding portion is not less than a certain value may be used. Alternatively, the integral value, maximum value, or minimum value of circumferential stress from the coil innermost winding portion to a given radial position may be used.

Collapsing is considered to occur because the radial compressive stress in the coil is weak and slippage between the layers of the coil occurs due to insufficient friction between the layers of the coil. From the viewpoint of preventing collapsing, it is effective to give the radial stress in the coil as the objective variable or the constraint condition. Specifically, in the case where compressive stress is expressed as negative value, a condition that the integral value of radial stress from the coil innermost winding portion to the coil outermost winding portion, expressed by the following Formula (8), is not greater than a certain value is used.

$$\int_{r_c}^{r_s}\sigma_r dr \tag{8}$$

In the case where a specific region of the coil influences collapsing, an integral value expressed by the following Formula (9), which is yielded by multiplying the integral value in Formula (8) by appropriate weighting factor w(r), may be used:

$$\int_{r_c}^{r_s}w(r)\sigma_r dr \tag{9}$$

When determining the coiling tension pattern of the steel sheet, both the circumferential stress distribution of the coil and the radial stress distribution of the coil may be used as the objective variable or the constraint condition. In the case where only one of kinking and collapsing is problematic, the one of kinking and collapsing may be used for the objective variable or the constraint condition.

By determining the coiling tension pattern of the steel sheet using the apparent elastic modulus in the coil radial direction by the foregoing method, kinking and collapsing can both be prevented.

The presently disclosed techniques are effective when the steel sheet coiled is a steel sheet commonly classified as a thin sheet with a sheet thickness of 3 mm or less. Since the likelihood of kinking and collapsing is higher when the sheet thickness is thinner, the presently disclosed techniques are particularly effective when the sheet thickness is 0.5 mm or less.

The presently disclosed techniques that use the elastic modulus in the coil radial direction to determine the coiling tension pattern of the steel sheet are particularly effective in the case where the steel sheet has a coating layer on its surface. The coating layer formed on the steel sheet surface is typically softer than the steel sheet and causes a decrease in the apparent elastic modulus in the coil radial direction. In such a case, the stress distribution in the coil significantly differs from the case where the elastic modulus in the coil radial direction is assumed to be the elastic modulus of the bulk steel sheet. Hence, the appropriate coiling tension pattern of the steel sheet is different, too.

Examples of the coating layer on the steel sheet surface include a hot-dip galvanizing or an electrogalvanized plating of a coated or plated steel sheet, a polyethylene terephthalate (PET) or polypropylene (PP) coating of a laminate steel sheet, an annealing separator applied after decarburization annealing of a grain-oriented electrical steel sheet and mainly containing magnesium oxide (MgO), and an insulating coating applied after final annealing of a non-oriented electrical steel sheet.

EXAMPLES

Examples according to the present disclosure will be described below, although the present disclosure is not limited to such.

Example 1

Figure 5:
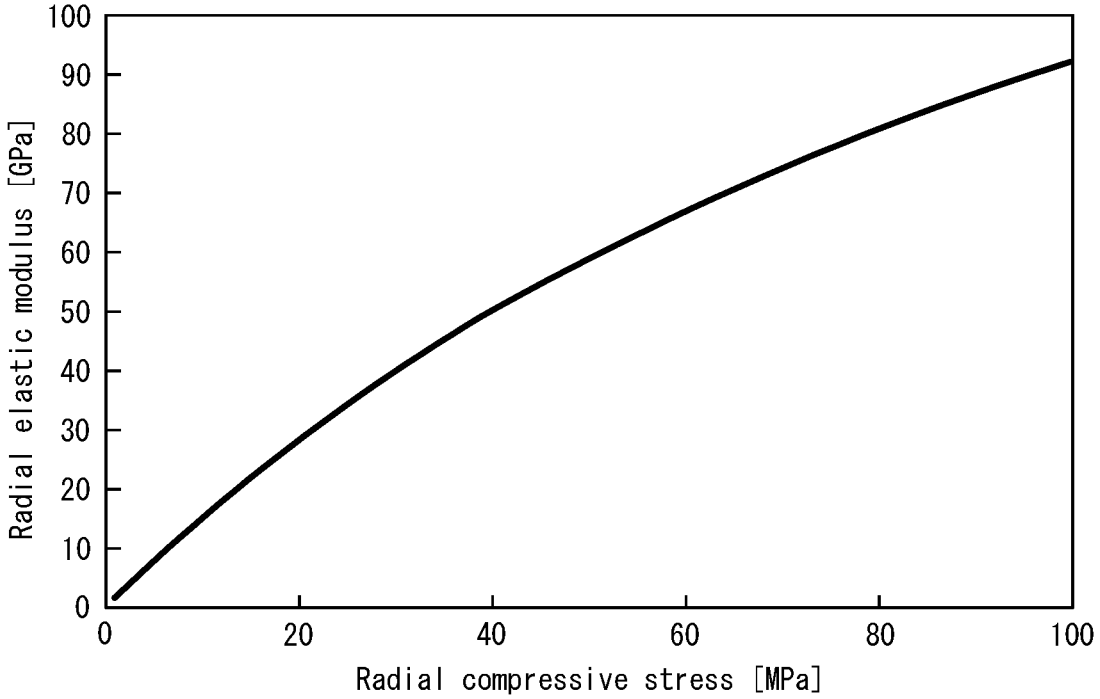
FIG. 5 is a diagram illustrating the pressure dependence of the elastic modulus in the radial direction of a coil measured using stacked steel sheets in Example 1.
Figure 6:
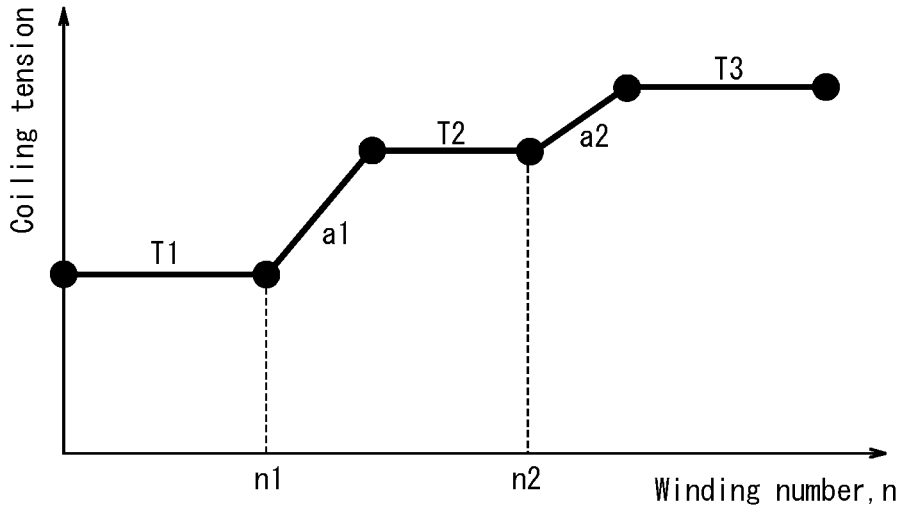
FIG. 6 is a diagram explaining parameters representing a coiling tension pattern set in Example 1.

300 samples of 50 mm square were cut out from a cold-rolled steel sheet of 0.5 mm in sheet thickness. The 300 samples cut out were stacked in the sheet thickness direction without removing an annealing separator. By the method illustrated in FIG. 1, pressure was applied to the stacked steel sheets in the sheet thickness direction, and the strain in the sheet thickness direction of the stacked steel sheets was measured to measure the elastic modulus of the stacked steel sheets as the elastic modulus in the coil radial direction. FIG. 5 illustrates the elastic modulus in the coil radial direction against the measured stress in the coil radial direction. Using the obtained elastic modulus in the coil radial direction, the stress distribution in the coil was calculated by the foregoing prediction model using Formulas (1) to (7) under the coil conditions shown in Table 1, and the coiling tension pattern of the steel sheet was determined. Here, the coiling tension pattern was determined using, as parameters, three levels of tension T1, T2, and T3, coil winding numbers n1 and n2 at which a change in tension starts, and tension change rates $\alpha 1$ and $\alpha 2$ in tension change intervals, as illustrated in FIG. 6.

TABLE 1

| Coil inner diameter [mm] | Coil outer diameter [mm] | Sheet thickness [mm] | Elastic modulus in coil circumferential direction [GPa] |
|---|---|---|---|
| 250 | 750 | 0.5 | 210 |

The initial condition of each of these parameters and the upper and lower limits of the parameter as the constraint condition are shown in Table 2. Moreover, for the purpose of preventing kinking of the coil, an objective variable was set so as to maximize the circumferential stress of the coil innermost diameter portion, that is, minimize the compressive stress of the coil innermost diameter portion. Furthermore, from the viewpoint of preventing collapsing of the coil, while the integral value of the radial stress in the coil expressed by Formula (8) when coiling the steel sheet under the initial conditions shown in Table 2 is −340 MPa·mm, a constraint condition that the integral value is −350 MPa·mm or less was added as a condition for further preventing collapsing.

TABLE 2

| | T1 [MPa] | T2 [MPa] | T3 [MPa] | n1 | n2 | $\alpha 1$ [MPa/mm] | $\alpha 2$ [MPa/mm] |
|---|---|---|---|---|---|---|---|
| Initial condition | 30 | 30 | 30 | 100 | 1000 | 0.1 | 0.1 |
| Upper limit | 5 | 5 | 5 | 1 | 1 | 0.001 | 0.001 |
| Lower limit | 80 | 80 | 80 | 1000 | 1000 | 1 | 1 |

Figure 7:
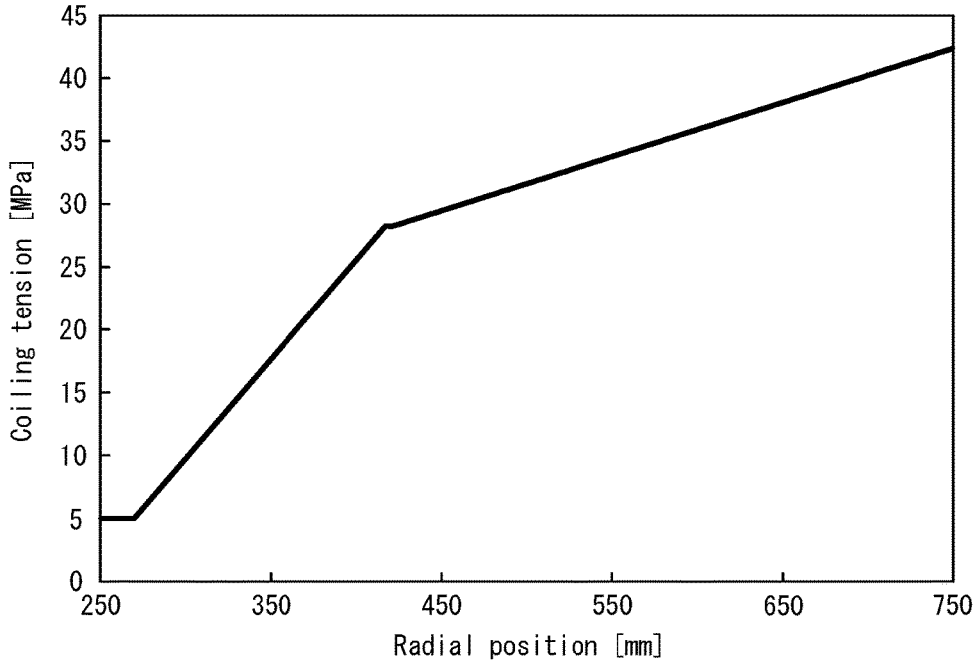
FIG. 7 is a diagram illustrating a coiling tension pattern obtained by optimization calculation in Example 1.

FIG. 7 illustrates a tension pattern obtained as a result of optimization calculation based on these conditions. In Example 1, a pattern in which the steel sheet is coiled with the lower-limit tension in the initial stage and then the coiling tension is increased gradually and, at some midpoint, the coiling tension increase rate is lowered was found to be optimum for prevention of coil collapsing. The circumferential compressive stress of the coil innermost winding portion before the optimization was 18 MPa, which was reduced to 3.1 MPa after the optimization.

As a result of coiling the steel sheet using the tension pattern determined in this way, the steel sheet was able to be coiled without kinking and collapsing.

Example 2

Figure 8:
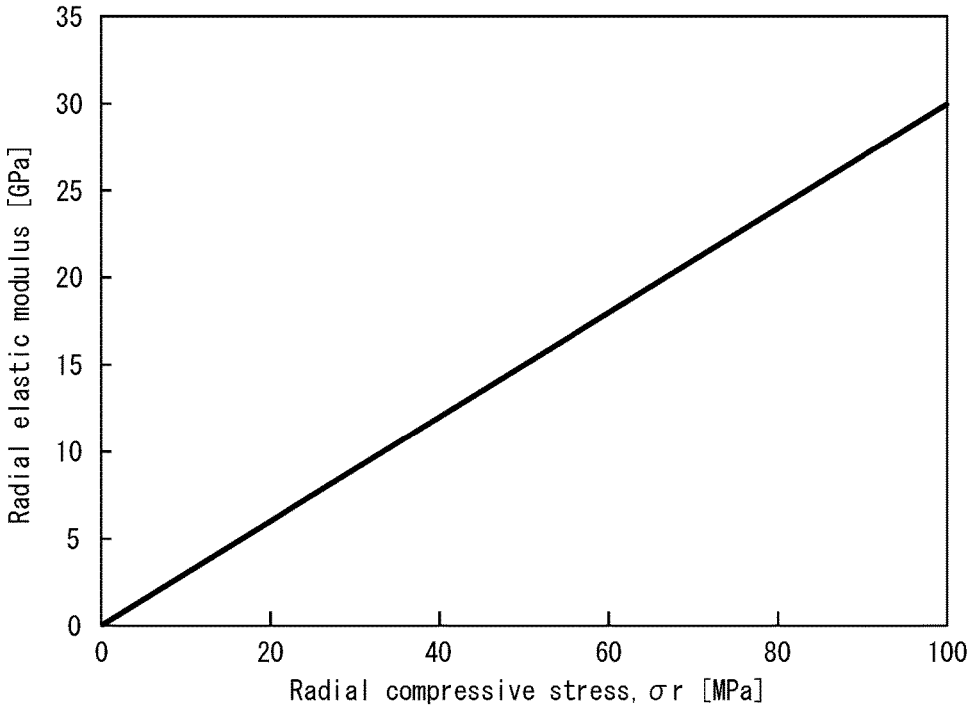
FIG. 8 is a diagram explaining parameters representing a coiling tension pattern set in Example 1.

300 samples of 50 mm square were cut out from a steel sheet obtained by decarburization annealing a grain-oriented electrical steel sheet of 0.23 mm in sheet thickness and then applying an annealing separator mainly containing MgO to both sides (surfaces) of the steel sheet. The 300 samples cut out were stacked in the sheet thickness direction without removing the annealing separator. By the method illustrated in FIG. 1, pressure was applied to the stacked steel sheets in the sheet thickness direction, and the strain in the sheet thickness direction of the stacked steel sheets was measured to measure the elastic modulus of the stacked steel sheets as the elastic modulus in the coil radial direction. FIG. 8 illustrates the elastic modulus in the coil radial direction against the measured stress in the coil radial direction. Using the obtained elastic modulus in the coil radial direction, the stress distribution in the coil was calculated by the foregoing prediction model using Formulas (1) to (7) under the coil conditions shown in Table 3, and the coiling tension pattern was determined. Here, the coiling tension pattern was determined using the parameters illustrated in FIG. 6, as in Example 1.

TABLE 3

| Coil inner diameter [mm] | Coil outer diameter [mm] | Sheet thickness [mm] | Elastic modulus in coil circumferential direction [GPa] |
|---|---|---|---|
| 250 | 640 | 0.23 | 210 |

The initial condition of each of these parameters and the upper and lower limits of the parameter as the constraint condition are shown in Table 4. Moreover, for the purpose of preventing kinking of the coil, an objective variable was set so as to maximize the circumferential stress of the coil innermost diameter portion, that is, minimize the compressive stress of the coil innermost diameter portion. Furthermore, from the viewpoint of preventing collapsing of the coil, while the integral value of the radial stress in the coil expressed by Formula (8) when coiling the steel sheet under the initial conditions shown in Table 4 is −1210 MPa·mm, a constraint condition that the integral value is −1480 MPa·mm or less was added as a condition for further preventing collapsing.

TABLE 4

| | T1 [MPa] | T2 [MPa] | T3 [MPa] | n1 | n2 | α1 [MPa/mm] | α2 [MPa/mm] |
|---|---|---|---|---|---|---|---|
| Initial condition | 100 | 100 | 100 | 100 | 1000 | 0.1 | 0.1 |
| Upper limit | 80 | 80 | 80 | 1 | 1 | 0.01 | 0.01 |
| Lower limit | 130 | 130 | 130 | 1000 | 1260 | 0.5 | 0.5 |

Figure 9:
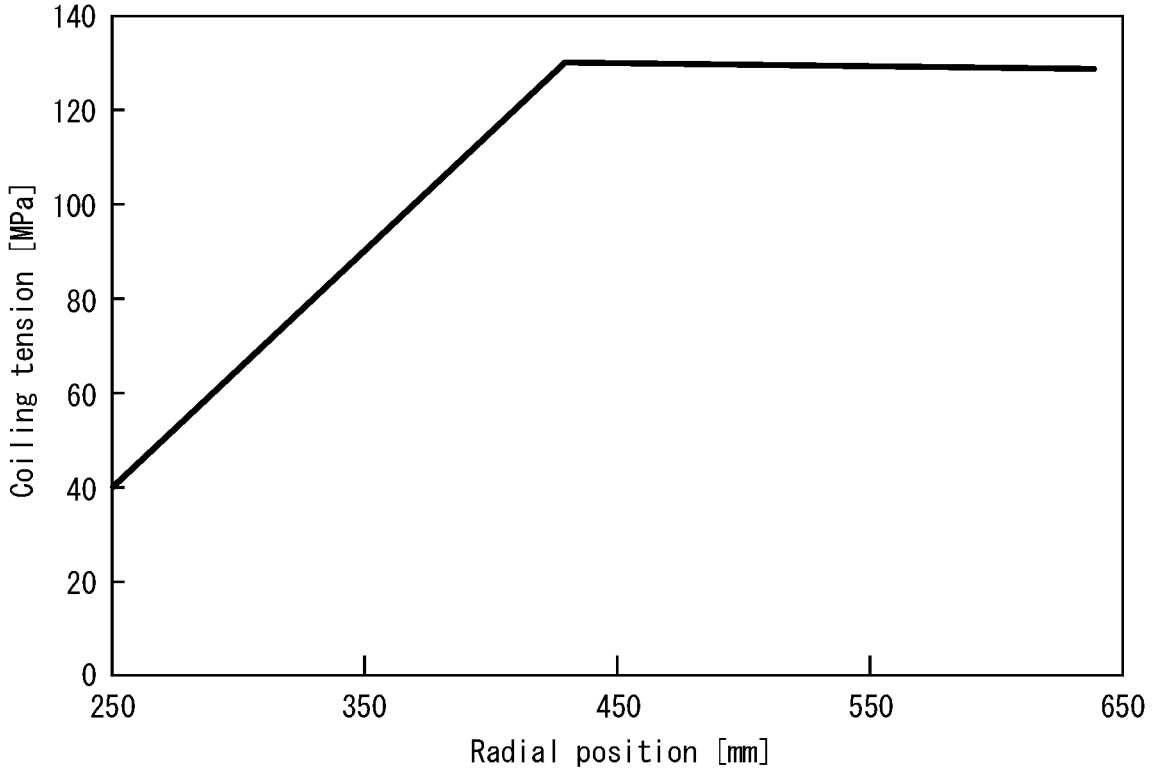
FIG. 9 is a diagram illustrating a coiling tension pattern obtained by optimization calculation in Example 2.

FIG. 9 illustrates a tension pattern obtained as a result of optimization calculation based on these conditions. In Example 2, a pattern in which the steel sheet is coiled with the lower-limit tension in the initial stage and then the coiling tension is increased gradually and, at some midpoint, the tension is raised to the upper limit was found to be optimum for prevention of coil kinking and collapsing. The circumferential compressive stress of the coil innermost winding portion before the optimization was 69 MPa, which was reduced to 29 MPa after the optimization.

As a result of coiling the steel sheet to which MgO was applied as the annealing separator using the tension pattern determined in this way, the steel sheet was able to be coiled without kinking and collapsing.

INDUSTRIAL APPLICABILITY

The presently disclosed techniques can prevent either or both of kinking and collapsing of a steel sheet coiled in coil form regardless of the characteristics of the steel sheet, and thus are useful in ironmaking.

REFERENCE SIGNS LIST

1 stacked steel sheets
2 pad
3 pressure
4 height of stacked steel sheets
5 mandrel
6 coil innermost layer
7 coil outermost layer

The invention claimed is:

1. A method of coiling a steel sheet, the method comprising:

determining a tension pattern of tension applied to the steel sheet when coiling the steel sheet on a mandrel of a tension reel; and coiling the steel sheet on the mandrel of the tension reel according to the determined tension pattern to achieve a coil, wherein the determining the tension pattern comprises calculating a stress distribution in the coil after removal from the mandrel using an apparent elastic modulus in a radial direction of a coil comprising steel sheet layers and an air layer present therebetween, the apparent elastic modulus being obtained through actual measurement.

2. The method of coiling a steel sheet according to claim 1, wherein when determining the tension pattern, circumferential stress in the coil after removal from the mandrel is used as an objective variable or a constraint condition.

3. The method of coiling a steel sheet according to claim 1, wherein when determining the tension pattern, radial stress in the coil after removal from the mandrel is used as an objective variable or a constraint condition.

4. The method of coiling a steel sheet according to claim 1, wherein a sheet thickness of the steel sheet is 0.5 mm or less.

5. The method of coiling a steel sheet according to claim 1, wherein the steel sheet has a coating layer on at least one surface thereof.

6. The method of coiling a steel sheet according to claim 2, wherein when determining the tension pattern, radial stress in the coil after removal from the mandrel is used as an objective variable or a constraint condition.

7. The method of coiling a steel sheet according to claim 2, wherein a sheet thickness of the steel sheet is 0.5 mm or less.

8. The method of coiling a steel sheet according to claim 3, wherein a sheet thickness of the steel sheet is 0.5 mm or less.

9. The method of coiling a steel sheet according to claim 2, wherein the steel sheet has a coating layer on at least one surface thereof.

10. The method of coiling a steel sheet according to claim 3, wherein the steel sheet has a coating layer on at least one surface thereof.

11. The method of coiling a steel sheet according to claim 4, wherein the steel sheet has a coating layer on at least one surface thereof.

* * * * *